US009470019B1

(12) United States Patent
Davis

(10) Patent No.: US 9,470,019 B1
(45) Date of Patent: Oct. 18, 2016

(54) METHOD AND APPARATUS FOR IMPROVED GATE LOCK

(71) Applicant: Roger Davis, Theodore, AL (US)

(72) Inventor: Roger Davis, Theodore, AL (US)

( * ) Notice: Subject to any disclaimer, the term of this patent is extended or adjusted under 35 U.S.C. 154(b) by 0 days.

(21) Appl. No.: 14/997,511

(22) Filed: Jan. 16, 2016

(51) Int. Cl.

| | |
|---|---|
| ***E05B 65/06*** | (2006.01) |
| ***E05B 65/00*** | (2006.01) |
| ***E05C 19/12*** | (2006.01) |
| ***E05C 7/04*** | (2006.01) |
| ***E05B 63/04*** | (2006.01) |

(52) U.S. Cl.
CPC ..... *E05B 65/0007* (2013.01); *E05B 63/04* (2013.01); *E05C 7/04* (2013.01); *E05C 19/12* (2013.01)

(58) Field of Classification Search
CPC .... E05B 63/04; E05B 63/042; E05B 63/044; E05B 65/00; E05B 65/0003; E05B 65/0007; E05B 73/00; E05B 73/007; E05B 73/0076; E05B 73/0094; E05B 73/02
See application file for complete search history.

(56) References Cited

U.S. PATENT DOCUMENTS

| | | | | |
|---|---|---|---|---|
| 1,395,970 A | | 11/1921 | Nidermaier | |
| 2,508,302 A | | 5/1950 | Sine | |
| 3,664,164 A | | 5/1972 | Zaidener | |
| 3,955,837 A | * | 5/1976 | Christensen | A01K 1/0017 292/173 |
| 4,136,540 A | * | 1/1979 | Coralli | E05B 63/0017 292/142 |
| 4,371,200 A | * | 2/1983 | Porter | E05B 65/0007 292/127 |
| 4,571,965 A | | 2/1986 | Le Roux | |
| 4,798,065 A | * | 1/1989 | DeForrest, Sr. | E05B 63/044 70/129 |
| 4,899,490 A | | 2/1990 | Jokel | |
| 5,103,658 A | * | 4/1992 | McQuade | E05B 65/0007 49/394 |
| 5,145,222 A | | 9/1992 | Meyer | |
| 5,186,588 A | * | 2/1993 | Sutton | E05B 73/00 182/127 |
| 5,573,287 A | * | 11/1996 | Takimoto | E05B 57/00 292/106 |
| 5,996,736 A | | 12/1999 | Stankiewicz | |
| 8,966,947 B2 | * | 3/2015 | Karcz | E05B 65/0007 292/210 |
| 2001/0052252 A1 | * | 12/2001 | Farmer | B60D 1/60 70/285 |
| 2006/0284428 A1 | * | 12/2006 | Beadle | A01K 1/0017 292/302 |
| 2010/0045055 A1 | * | 2/2010 | Taglianetti | E05B 1/0015 292/341.15 |

* cited by examiner

*Primary Examiner* — Christopher Boswell
(74) *Attorney, Agent, or Firm* — George L Williamson

(57) ABSTRACT

Method and apparatus for a heavy duty lock designed for manual gates which is designed to be tamper proof, for universal mounting, for left and right hand applications and for use on swing gates and slide gates. The lock has a housing having a lock release mechanism having a release arm thereon which is suitable for use with a key which release arm manually contacts and slides a latch release slide upwardly and downwardly which then contacts a removable latch plate which in an open position allows the latch bar to be removed from the latch bar guide and cover so that the gate can be opened.

18 Claims, 3 Drawing Sheets

METHOD AND APPARATUS FOR IMPROVED GATE LOCK

BACKGROUND OF THE INVENTION

1. Field of the Invention

The present invention relates generally to locks and, more particularly, is concerned with an improved gate lock.

2. Description of the Related Art

Devices relevant to the present invention have been described in the related art, however, none of the related art devices disclose the unique features of the present invention.

In U.S. Pat. No. 5,996,736 dated Dec. 7, 1999, Stankiewicz disclosed a ladder locking device. In U.S. Pat. No. 4,571,965 dated Feb. 25, 1986, Le Roux disclosed a bicycle lock. In U.S. Pat. No. 2,508,302 dated May 16, 1950, Stue disclosed a portable clamp lock. In U.S. Pat. No. 5,145,222 dated Sep. 8, 1992, Meyer disclosed a device for locking tractor trailer and sea rail container doors. In U.S. Pat. No. 4,899,490 dated Feb. 13, 1990, Jokel disclosed a window intrusion barrier. In U.S. Pat. No. 1,395,970 dated Nov. 1, 1921, Nidermaier disclosed an automobile locking device. In U.S. Pat. No. 3,664,164 dated May 23, 1972, Zaidener disclosed a locking mechanism.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a heavy duty lock designed for manual gates which is designed to be tamper proof, for universal mounting, for left and right hand applications and for use on swing gates and slide gates. The present invention comprises a housing having a lock release mechanism having a release arm thereon which is suitable for use with a key which release arm manually contacts and slides a latch release slide upwardly and downwardly which then contacts a removable latch plate which in an open position allows the latch bar to be removed from the latch bar guide so that the gate can be opened. Single and double gate versions are also provided.

An object of the present invention is to provide an improved lock for a manual gate. A further object of the present invention is to provide an extremely heavy duty lock for remote locations where the risk of a break-in is greater. A further object of the present invention is to provide a universally mountable lock which is tamper proof and has left hand or right hand applications. A further object of the present invention is to provide an improved lock which can be used on swing gates or sliding gates. A further object of the present invention is to provide a lock which can be relatively easily and inexpensively manufactured. A further object of the present invention is to provide an improved lock which can be relatively easily operated by a user.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
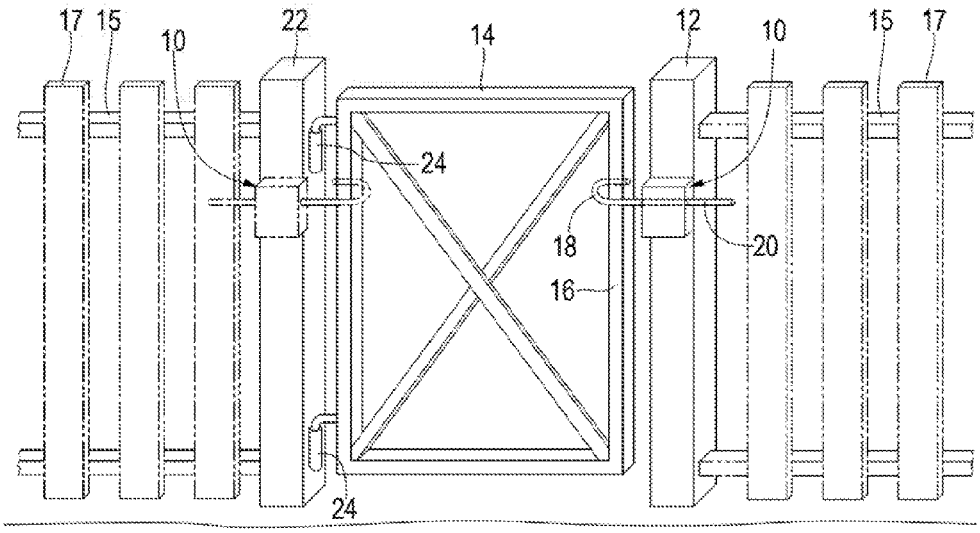
FIG. 1 is a front perspective view of a single gate embodiment of a right hand version of the present invention in operative connection.

With regard to reference numerals used, the following numbering is used throughout the drawings.

10 present invention
12 gate post
14 gate
15 rail of fence
16 gate upright frame member
17 picket of fence
18 hook of latch bar
20 latch bar
22 gate post
24 hinges of gate
26 left gate
28 right gate
30 left gate upright frame member
31 right gate upright frame member
32 housing
33 back plate
34 base plate
36 lock release assembly
37 key
38 release arm for latch release slide
40 latch release slide
42 left latch release slide guide
44 right latch release slide guide
46 left trigger for latch plate release
48 right trigger for latch plate release
50 reversible latch plate
52 axle
54 tip of latch plate
56 notch
58 face of wall of notch
60 mounting hole

62 right cover lock
64 left cover lock
66 notch of cover lock
68 cover
69 upper cover lock
70 left latch bar guide
72 right latch bar guide
74 left latch release slide spring
76 right latch release slide spring
78 attachment point for hook
80 attachment point for hook of spring
82 reversible latch plate spring
84 lug
86 tab
88 lock cylinder
90 lock nut
92 lock face plate
94 back hook
96 apertures
98 gate post
100 sliding gate portion
102 upright frame member
104 gate post
106 rails
108 roller
110 roller
112 supporting surface
14 rails
116 metal portion

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 7 illustrate the present invention wherein an improved gate lock is disclosed and which is generally indicated by reference number 10.

Throughout this specification, references to either "left" or "right" hand sides refer to left and right sides which would be seen by the reader looking into the page in the conventional manner. Arrows may also be shown to indicate motion of a part Turning to FIG. 1, therein is shown a single gate version of a right hand version (with a left hand version shown in phantom lines) of the present invention 10 in operative connection on a gate post 12 wherein a swinging gate portion 14 having an upright frame member 16 around which the hook 18 of the latch bar 20 of the present invention 10 is partially encircled. Also shown is an opposing gate post 22 having a pair of hinges 22 mounted thereon upon which the gate 14 swings in a conventional manner. The remaining portion of the fence, e.g., rails 15 and pickets 17 or the equivalent metal portions or the like, would be constructed in the standard manner as would be done by one skilled in the art. A left hand version of the present invention 10 is shown in phantom lines attached to the gate post 22; of course, with this left hand version the hinges 24 would be moved to the opposite side of the gate 14 as would be done in the standard manner by one skilled in the art. The single gate version shown in FIG. 1 is expected to be manufactured in a right and left hand version of the present invention 10.

Figure 2:
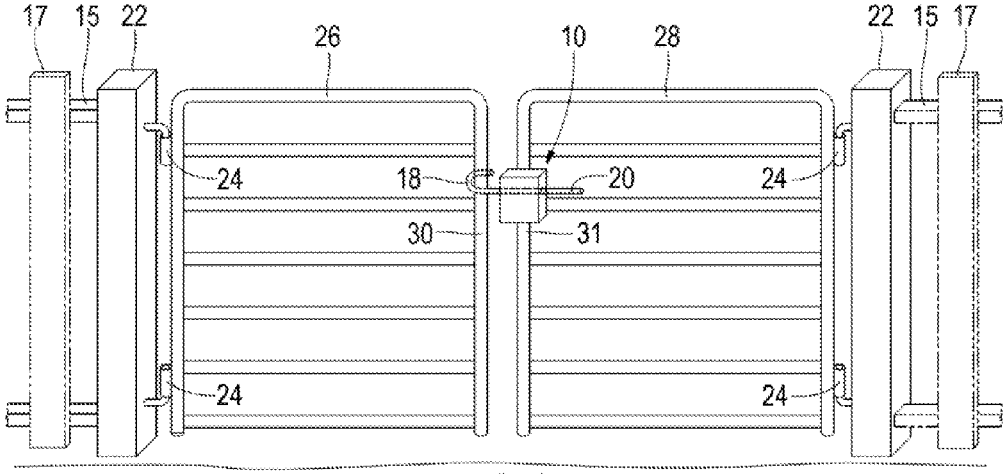
FIG. 2 is a front perspective view of a double gate embodiment of a right hand version of the present invention in operative connection.

Turning to FIG. 2, therein is shown a double gate version of a right hand version of the present invention 10 having a left swinging gate portion 26 and a right swinging gate portion 28 upon which the present invention 10 is mounted on the right gate so that the hook 18 of the latch bar 20 hooks around the left upright frame member 30. The present invention 10 is mounted on a right upright frame member 31 of the double gate and also includes a back hook (not shown, see item 94 on FIG. 5) which connects the housing of the present invention 10 to the right upright member 31 of the double gate. The double gate version shown in FIG. 2 is expected to only be manufactured as a right hand version. Other items similar to that disclosed in FIG. 1 are also shown as would be adapted for use with a double gate by one skilled in the art.

Figure 3:
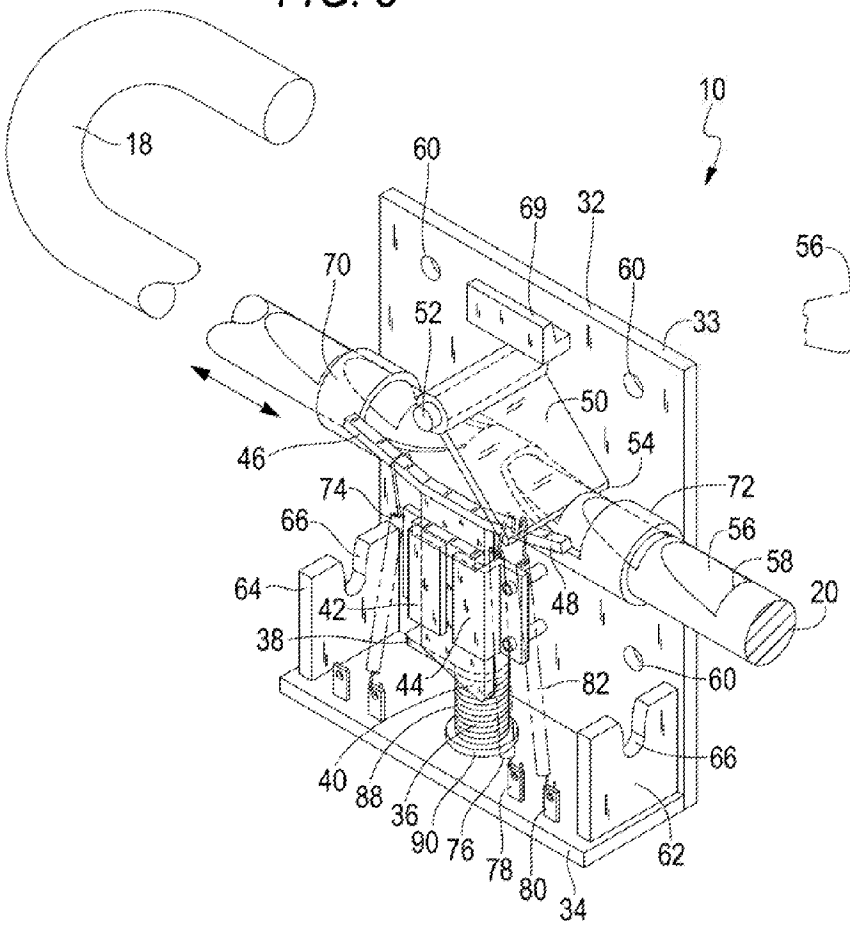
FIG. 3 is a front perspective view of an internal portion of a right hand version of a single gate version of the present invention taken from the right side.

Turning to FIGS. 3-7, therein are shown additional details of the present invention 10. Turning to FIG. 3 initially, therein is shown a perspective view of internal portions of a right hand version of the present invention 10 showing the back plate 33 of back portion of housing 32 along with a bottom base plate 34 through which a lock release assembly 36 is disposed for receiving a key (not shown, see item 37 in FIG. 6) in the conventional manner having a rotatable release arm 38 wherein the release arm contacts the angled face of a latch release slide 40 which moves up and down vertically in a left 42 and right 44 latch release slide guide having disposed on its upper end a left trigger arm 46 for a latch plate release and a right trigger arm 48 for a latch plate release 50 which trigger arm 48, for the right hand version shown in FIG. 3, contacts the reversible latch plate 50 which is swingably disposed on an axle 52 and is reversible for left and right hand operation wherein the tip 54 of the latch plate 50 fits into one of a plurality of side-by-side notches 56 on a straight portion of the latch bar 20 having the hook member 18 of the latch bar thereon. Each notch has a face 58 thereon which face is contacted by the tip 54 of the latch plate 50 and which locks the substantially horizontally disposed latch bar 20 in place.

Figure 5:
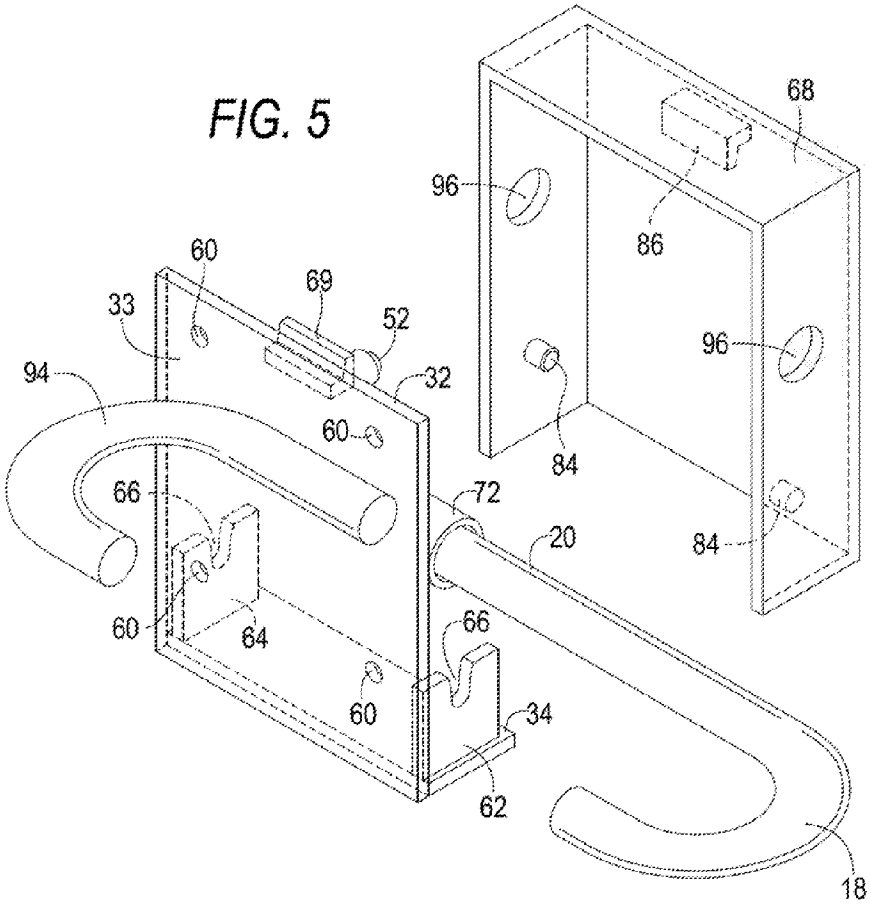
FIG. 5 is a rear perspective view of portions of a double gate embodiment of the present invention.
Figure 4:
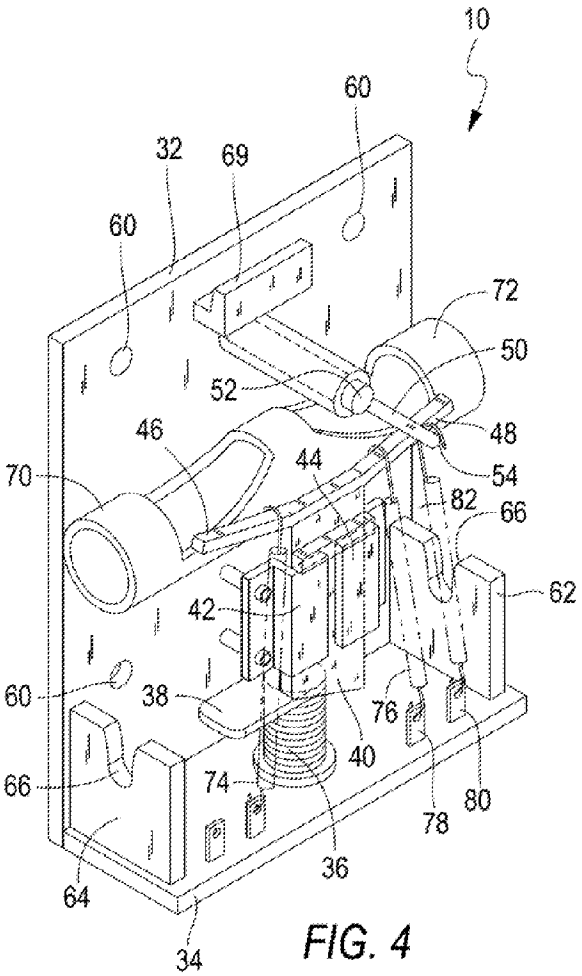
FIG. 4 is a front perspective view of an internal portion of a right hand version of a single gate version of the present invention taken from the left side.

Also shown as part of the housing 32 are multiple mounting holes 60 placed near the corners of the back plate 33 in a conventional manner having a right cover lock 62 and left cover lock 64 each having a notch 66 therein for receiving a lug 84 disposed on the inside of the cover (not shown, see Item 68 in FIG. 5). Also shown on an upper end of the back plate 33 of housing 32 is an upper cover lock 69 which functions in the conventional manner by receiving a mating tab 86 mounted on the inside of the cover 68. The latch bar 20 slides horizontally in a left latch bar guide 70 and a right guide 72 and is user selectively adjustable so that the user can fix or tighten the hook 18 about the appropriate gate member. Note the plurality of springs each having first and second ends with hooks thereon wherein a pair of springs 74, 76 extend from an attachment point eye 78 on the housing base plate 34 and the left 46 and right 48 trigger latch plate release and are referred to as a left latch release slide spring 74 and the right latch release slide spring 76. An optional third spring 82 also extends from its attachment point eye 80 to the upper reversible latch plate 50 and is referred to as the reversible latch plate spring 82.

Figure 6:
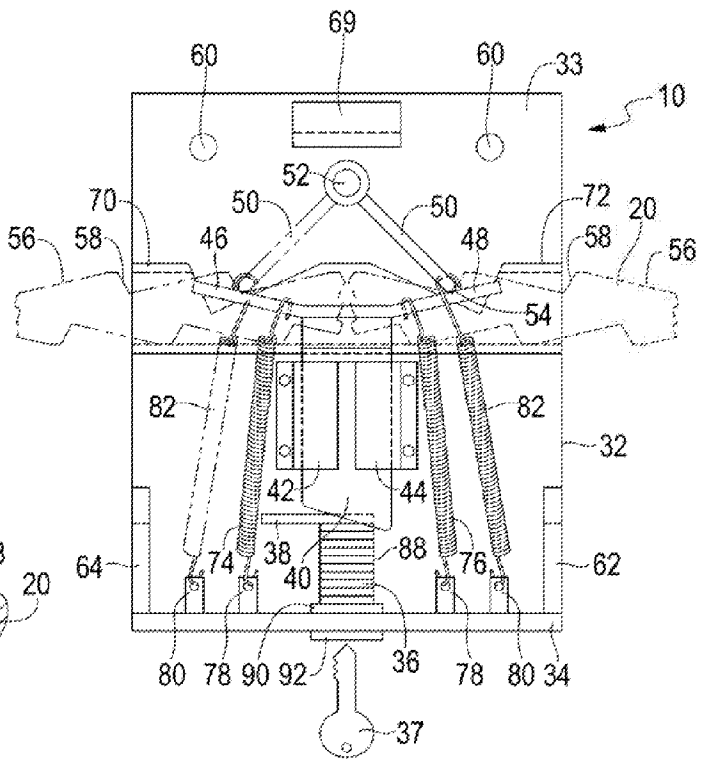
FIG. 6 is a front elevation view of an internal portion of the present invention showing components for a left and right hand version.

Also shown on FIG. 3 is the lock cylinder 88 secured on the inside of base plate 34 using a lock nut 90. FIG. 6 shows a lock face plate 92 and key 37 for insertion and operation, in the conventional manner, with the lock release mechanism/assembly 36 which includes the lock cylinder 88 (see FIG. 3).

FIG. 5 shows back hook 94 mounted onto the rear outer surface of back plate 33 for use with a double gate version as shown in FIG. 2. FIG. 5 also shows cover 68 being removably attachable to the housing portion 32 by placing lugs 84 into mating lower left and right notches 66 and placing tab 86 onto and behind upper cover lock 69 so that the cover 68 is secured to the rear portion 32 of the housing by the latch bar 20 passing through opposing left and right apertures 96 on the outer or lateral side or edge portions of cover 68 and by the latch bar also passing through co-aligned left and right latch bar guides 70, 72 as best shown in FIG. 3, which, taken together, provides a very strong and secure lock which is difficult to be broken into. Reference to housing 32, in general, of the present invention 10 includes cover 68 being attached to back plate portion 33 as would be required in operative connection as shown in FIGS. 1, 2 and 7.

FIG. 6 shows the reversible latch plate 50 rotated toward the right side for use with the right hand version of the lock as shown in FIG. 1, while also showing the reversible latch plate 50 on the left side by using phantom lines which position would also necessitate using the left optional spring 82 (shown in phantom lines) and disconnecting the right spring 82 so that the reversible latch plate 50 would be biased downwardly against latch bar 20. Also, note that notches 56 are disposed on latch bar 20 so as to be oriented for right hand use on a right portion of the latch bar and oriented for left hand use on a left portion of the latch bar. This allows a single latch bar 20 to be used with both left and right hand versions of the present invention 10.

Figure 7:
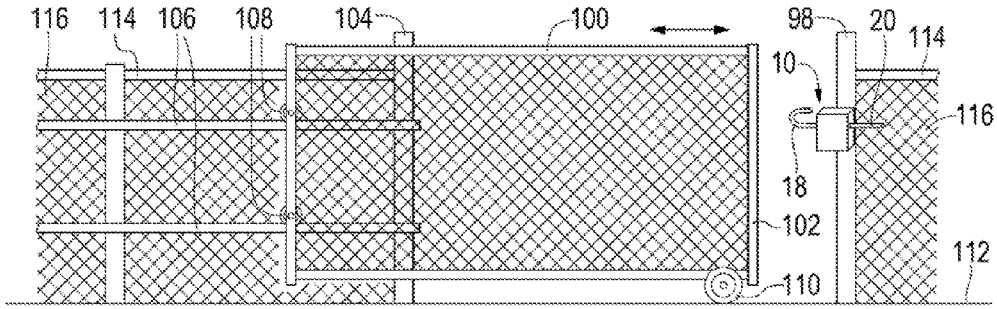
FIG. 7 is a front perspective view of a sliding gate embodiment of a right hand version of the present invention.

FIG. 7 shows a sliding gate version of a right hand version of the present invention 10 in operative connection on a gate post 98 wherein a sliding gate portion 100 having an upright frame member 102 around which the hook 18 of the latch bar 20 of the present invention 10 can be partially encircled. Also shown is an opposing gate post 104 having a pair of rails 106 mounted thereon upon which rollers 108 can roll back and forth with the gate 100 in a conventional manner. An additional roller 110 supports a lower end of gate 100 on a supporting surface such as the ground or a paved surface. The remaining portion of the fence, e.g., rails 114 and pickets or equivalent metal portions 116 or the like, would be constructed in the standard manner as would be done by one skilled in the art. The sliding gate version shown in FIG. 7 is expected to be manufactured in a right and left hand version of the present invention 10 similar to the embodiment shown in FIG. 1.

In summary of the unlocking operation of the present invention 10, and with reference to FIGS. 1-6, a user would insert a key 37 into the lock release assembly 36 and turn the key clockwise so that the release arm for latch release slide 38 rotates clockwise thereby contacting and causing latch release slide 40 to move upwardly in the left and right latch release slide guides 42, 44 causing left and right triggers for latch plate release 46, 48 to lift tip 54 of reversible latch plate 50 away from face 58 of notch 56 of latch bar 20 so that the latch bar 20 can be slidably removed from the left and right latch bar guides 70, 72 and the apertures 96 of housing 32 which allows the gate 14, 26, 28 to be opened. Also, cover 68 can be removed if desired as previously described.

Exemplary dimensions and materials of construction of the present invention 10 follow: The housing 32 with cover 68 is approximately 6 inches high, 4.5 inches wide and 2.25 inches in depth and is expected to be made of 0.25 inch tempered steel. The latch bar 20 and hook 18 is approximately 0.75 inches in diameter and about 1 foot and 10 inches long and is expected to be made of tempered steel and may be chrome plated. One skilled in the art would recognize that the present invention 10 is a heavy duty lock intended for use in isolated locations where the risk of a break-in is higher.

By way of additional summary and with reference to FIGS. 1-7, the present invention 10 discloses a gate lock for locking a movable gate member 14, 26, 28, 100 to an upright gate post 12, 22, 98 and includes a) mounting a housing 32, 33, 68 onto the upright gate post, the housing having left and right apertures 96 therein so that the left aperture is disposed on a first side portion of the housing and the right aperture is disposed on a second side portion of the housing; b) providing a key 37 operated lock mechanism 36 inside the housing; c) disposing a latch plate 50 inside the housing, wherein the latch plate moves between first and second positions in response to operation of the lock mechanism; d) providing a latch bar 20 having first and second opposing ends and a plurality of spaced apart notches 56 thereon, and disposing a hook 18 on the first end thereof wherein the hook is capable of partially encircling and thereby capturing a first movable gate member; and, e) wherein the latch bar is slidably disposed in the left and right apertures 96 of the housing 96 so that the latch plate contacts the notches when the latch plate is in the first position and the latch plate is spaced away from the notches when the latch plate is in the second position, wherein the latch bar is thereby secured to the housing so that the first movable gate member is selectively locked to and unlocked from the upright gate post. Further, the latch bar is capable of being inserted into and through the housing from either the first or the second side portion so that the gate lock is capable of securing either a right hand or a left hand gate (see FIG. 1). Also, further comprising the step of providing a removable cover 68 on the housing 32, 33 so that the left aperture is disposed on a first side portion of the cover and the right aperture is disposed on a second side portion of the cover and further comprising the step of disposing first and second latch bar guides 70, 72 inside the housing, wherein the first and second latch bar guides are co-aligned with the left and right apertures on the cover, wherein the latch bar is slidable through the first and second latch bar guides so that the notches are capable of contacting the latch plate to permit the latch bar to be secured to the housing. Also, further comprising the step of providing a latch release slide 40 having a latch plate release 46, 48 thereon, wherein the latch release slide 40 moves in response to operation of the lock mechanism and the latch plate 50 moves in response to movement of the latch release slide 40 and the latch plate is pivotally mounted on an axle 52 so as to be reversible for use with either a right hand or a left hand gate and wherein a first set of the notches are disposed on a first surface of the latch bar and a second set of the notches are disposed on a second surface of the latch bar so that the latch bar is capable of operating with either a right hand or a left hand gate as shown in FIG. 6. Also, further comprising the step of disposing a second hook 94 on the housing for attachment to a second movable gate member 30 so that the housing is mounted onto the second movable gate member thereby allowing the gate lock to operate with a double gate having first and second movable gate members 26, 28 and wherein the gate lock is adapted for use with a sliding gate 100 or a swinging gate 14, 26, 28.

I claim:

1. A gate lock for locking a movable gate member to an upright gate post, comprising:

a) a housing mounted onto the upright gate post, said housing having left and right apertures therein, wherein said left aperture is disposed on a first side portion of said housing and said right aperture is disposed on an second side portion of said housing;

b) a key operated lock mechanism disposed on an inside of said housing;

c) a pivoted latch plate disposed inside said housing, wherein said latch plate pivots between a first, lower position and a second, upper position in response to operation of said lock mechanism, and means biasing said latch plate into said first, lower position;

d) a latch bar having first and second opposing ends slidably disposed in said left and right apertures of said housing, and a plurality of spaced apart notches disposed on said latch bar, a hook disposed on said first end of said latch bar wherein said hook is adapted to partially encircle and thereby capturing a first movable gate member, each notch having a side wall intersecting a sloping bottom wall facing a distal tip end of said pivoted latch plate;

e) an extended trigger arm parallel with and spaced from said latch bar, and means biasing said trigger arm in a down position, said distal tip end of said latch plate being biased into engagement with said side wall of a notch in said latch bar thereby locking said latch bar and said hook in a locking position, said trigger arm adapted to engage an overhanging portion of said distal tip end of said latch plate when said trigger arm is raised; and f) said key operated mechanism having a latch release slide to urge said trigger arm upwardly to raise said tip end of said latch plate to disengage said tip end from said notch to allow sliding of said latch bar and hook out of engagement with said first movable gate member thereby allowing said gate member to be opened.

2. The gate lock of claim 1, wherein said latch bar is capable of being inserted through said housing from either said first or said second side portion so that the gate lock is capable of securing either a right hand or a left hand gate.

3. The gate lock of claim 2, further comprising a cover being removably disposed on said housing, wherein said left aperture is disposed on a first side portion of said cover and said right aperture is disposed on a second side portion of said cover.

4. The gate lock of claim 3, further comprising first and second latch bar guides disposed inside said housing, wherein said first and second latch bar guides are co-aligned with said left aid right apertures disposed on said cover, wherein said latch bar is slidable through said first and second latch bar guides so that said notches are capable of contacting said latch plate to permit said latch bar to be secured to said housing.

5. The gate lock of claim 4, further comprising a latch release slide having a latch plate release thereon, wherein said latch release slide moves in response to operation of said lock mechanism and said latch plate moves in response to movement of said latch release slide.

6. The gate lock of claim 5, wherein said latch plate is pivotally mounted on an axle so as to be reversible for use with either a right hand or a left hand gate.

7. The gate lock of claim 6, wherein a first set of said notches are disposed on a first surface of said latch bar and a second set of said notches are disposed on a second surface of said latch bar so that said latch bar is capable of operating with either a right hand or a left hand gate.

8. The gate lock of claim 7, further comprising a second hook disposed on said housing for attachment to a second movable gate member so that said housing is mounted onto said second movable gate member thereby allowing the gate lock to operate with a double gate having first and second movable gate members.

9. The gate lock of claim 8, wherein the gate lock is adapted for use with either a sliding gate or a swinging gate.

10. A method for a gate lock for locking a movable gate member to an upright gate post, comprising the steps of:

a) mounting a housing onto the upright gate post, the housing having left and right apertures therein so that the left aperture is disposed on a first side portion of the housing and the right aperture is disposed on a second side portion of the housing;

b) providing a key operated lock mechanism inside the housing;

c) disposing a pivoted latch plate inside the housing, wherein the latch plate pivots between a first lower position and a second upper position in response to operation of the lock mechanism, and biasing said latch plate into said first lower position;

d) providing a latch bar having first and second opposing ends slidably disposed in said left and right apertures of said housing, and a plurality of spaced apart notches on said latch bar, and disposing a hook on the first end of said latch bar wherein the hook partially encircles and thereby capturing a first movable gate member, each notch having a side wall intersecting a sloping bottom wall facing a distal tip end of said pivoted latch plate for engagement; and, e) providing an extended trigger arm parallel with and spaced from said latch bar, and means biasing said trigger arm in a down position, said distal tip end of said latch plate being biased into engagement with said side wall of a notch in said latch bar thereby locking said latch bar and said hook in a locking position, said trigger arm adapted to engage an overhanging portion of said distal tip end of said latch plate when said trigger arm is raised; and f) said key operated mechanism having a latch release slide to urge said trigger arm upwardly to raise said tip end of said latch plate to disengage said tip end from said notch to allow sliding of said latch bar and hook out of engagement with said first movable gate member thereby allowing said gate member to be opened.

11. The method of claim 10, wherein the latch bar is capable of being inserted into and through the housing from either the first or the second side portion so that the gate lock is capable of securing either a right hand or a left hand gate.

12. The method of claim 11, further comprising the step of providing a removable cover on the housing so that the left aperture is disposed on a first side portion of the cover and the right aperture is disposed on a second side portion of the cover.

13. The method of claim 12, further comprising the step of disposing first and second latch bar guides inside the housing, wherein the first and second latch bar guides are co-aligned with the left and right apertures on the cover, wherein the latch bar is slidable through the first and second latch bar guides so that the notches are capable of contacting the latch plate to permit the latch bar to be secured to the housing.

14. The method of claim 13, further comprising the step of providing a latch release slide having a latch plate release thereon, wherein the latch release slide moves in response to operation of the lock mechanism and the latch plate moves in response to movement of the latch release slide.

15. The method of claim 14, wherein the latch plate is pivotally mounted on an axle so as to be reversible for use with either a right hand or a left hand gate.

16. The method of claim 15, wherein a first set of the notches are disposed on a first surface of the latch bar and a second set of the notches are disposed on a second surface of the latch bar so that the latch bar is capable of operating with either a right hand or a left hand gate.

17. The method of claim 16, further comprising the step of disposing a second hook on the housing for attachment to a second movable gate member so that the housing is mounted onto the second movable gate member thereby allowing the gate lock to operate with a double gate having first and second movable gate members.

18. The method of claim 17, wherein the gate lock is adapted for use with either a sliding gate or a swinging gate.

* * * * *